US010525726B2

(12) United States Patent
Kumagai

(10) Patent No.: US 10,525,726 B2
(45) Date of Patent: Jan. 7, 2020

(54) PRINTING METHOD AND PRINTING MEDIUM

(71) Applicant: SEIKO EPSON CORPORATION, Tokyo (JP)

(72) Inventor: Shiki Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/719,003

(22) Filed: Sep. 28, 2017

(65) Prior Publication Data

US 2018/0086098 A1 Mar. 29, 2018

(30) Foreign Application Priority Data

Sep. 29, 2016 (JP) ..... 2016-192146

(51) Int. Cl.
*B41J 2/21* (2006.01)

(52) U.S. Cl.
CPC ..... *B41J 2/2121* (2013.01); *B41J 2/2114* (2013.01)

(58) Field of Classification Search
CPC ..... B41J 2/2121; B41J 2/2054; B41J 2/2114; B41J 11/0015; B41M 5/0011
See application file for complete search history.

(56) References Cited

U.S. PATENT DOCUMENTS

2002/0015085 A1 2/2002 Moriyama et al.
2006/0176331 A1* 8/2006 Ishikawa ..... B41J 11/0015 347/16
2007/0188528 A1 8/2007 Kakutani
2011/0235071 A1* 9/2011 Fujita ..... B41J 2/2121 358/1.9

FOREIGN PATENT DOCUMENTS

JP 10-226055 8/1998
JP 2005-088342 4/2005
JP 2013-091226 5/2013

* cited by examiner

*Primary Examiner* — Henok D Legesse
(74) *Attorney, Agent, or Firm* — Workman Nydegger

(57) ABSTRACT

A printing method includes a step of forming a first image by ejecting a pretreatment liquid, and a step of forming a second image on the first image by ejecting a colored ink onto the first image. Here, the first image is allowed to include an extra portion by which the edge of the first image exists on the outside of the edge of the second image. Further, an amount of the ejection of the pretreatment liquid onto the extra portion per area at a position on the extra portion is allowed to be decreased further as the position is located further toward the outside from the edge of the second image.

7 Claims, 5 Drawing Sheets

PRINTING METHOD AND PRINTING MEDIUM

BACKGROUND

1. Technical Field

The present invention relates to a recording method employing a liquid ejection head configured to eject liquid through its nozzles, and a recording medium resulting from recording employing such a liquid ejection head. In particular, the invention relates to a recording method employing an ink jet recording head configured to eject ink serving as the liquid, and a recording medium resulting from recording employing such an ink jet recording head.

2. Related Art

Recently, as an output device for a computer, a printer that ejects inks through nozzles of its printing head has been in widespread use. For such a printer, there is known a technique that employs a pretreatment liquid to improve, for example, fixation to a recording medium (a medium) and a maximum ejection quantity. The pretreatment liquid is an ink not including color materials virtually, and is employed in a printing method that allows normal colored inks, that is, inks including color materials, to be ejected so as to be superposed on the pretreatment liquid.

For such a printing method, there is known a technology that is intended to improve printing quality in a way that, for each dot, controls the magnitude relation between the dot diameter of a pretreatment liquid and that of a colored ink by changing the dot diameter of the pretreatment liquid and that of the colored ink (see JP-A-10-226055).

For such a technology, however, dot shapes and dot diameters are very likely to be changed due to the variations of a printing head and ejection conditions, the variations of viscosity and any other characteristic of ink, the temporal change of the ink, and any other variation or change. Thus, it is very difficult to perform, for each dot, such the ejection and superposition based on the control of the magnitude relation between the dot diameter of the pretreatment liquid and that of the colored ink.

Further, when landing positions of a pretreatment liquid and corresponding landing positions of colored inks are out of alignment with each other, and further, in an edge area of each of images, the colored inks land on a portion where the pretreatment liquid does not exist, or the area of the pretreatment liquid extends to outside of the area of the colored inks, there arises a problem in that image quality is significantly degraded.

SUMMARY

An advantage of some aspects of the invention is that a printing method that prevents the degradation of image quality due to the occurrence of out-of-alignment conditions between landing positions of a pretreatment liquid and corresponding landing positions of colored inks is provided, and a printing medium resulting from printing employing such a printing method is provided.

According to a first aspect of the invention, a printing method includes a step of forming a first image by ejecting a pretreatment liquid, and a step of forming a second image on the first image by ejecting a colored ink onto the first image. Here, the first image is allowed to include an extra portion by which the edge of the first image exists on the outside of the edge of the second image. Further, an amount of the ejection of the pretreatment liquid onto the extra portion per area at a position on the extra portion is allowed to be decreased further as the position is located further toward the outside from the edge of the second image.

In the first aspect, even when the second image is out of alignment with the first image, the edge of the second image exists on the extra portion of the first image, and thus, the prevention of the degradation of image quality is achieved. Further, the extra portion of the first image is formed such that the ejection amount per area at a position on the extra portion is decreased further as the position is located further toward the outside. This configuration, therefore, brings about an advantageous effect of delustering a luster or the like that might be otherwise viewed on the first image, and thus, achieves the reduction of a large degradation of image quality.

In the first aspect of the invention, the extra portion of the first image may be formed by a plurality of dots that are arranged toward the outside from a position corresponding to the edge of the second image up to the edge of the first image. This configuration relatively easily reduces the amount of the ejection of the pretreatment liquid onto the extra portion per area.

Further, in the first aspect of the invention, preferably, the first image is formed under the second image so as to fully cover the second image. This configuration achieves the uniformization of the overall quality of the second image.

According to a second aspect of the invention, a printing medium includes a recording medium, a first image formed by ejecting a pretreatment liquid onto the recording medium, and a second image formed by ejecting a colored ink onto the first image. Further, the first image includes an extra portion by which the edge of the first image exists on the outside of the edge of the second image, and the amount of the ejection of the pretreatment liquid onto the extra portion per area at a position on the extra portion is decreased further as the position is located further toward the outside from the edge of the second image.

In this second aspect, even when the second image is out of alignment with the first image, the edge of the second image exists on the extra portion of the first image, and thus, a printing medium for which the degradation of image quality is prevented is achieved. Further, the extra portion of the first image is formed such that the ejection amount per area at a position on the extra portion is decreased further as the position is located further toward the outside. This configuration, therefore, brings about an advantageous effect of delustering a luster or the like that might be otherwise viewed on the first image, and thus, a printing medium for which a large degradation of image quality is reduced is achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in details on the basis of embodiments described below.

First Embodiment

Figure 1:
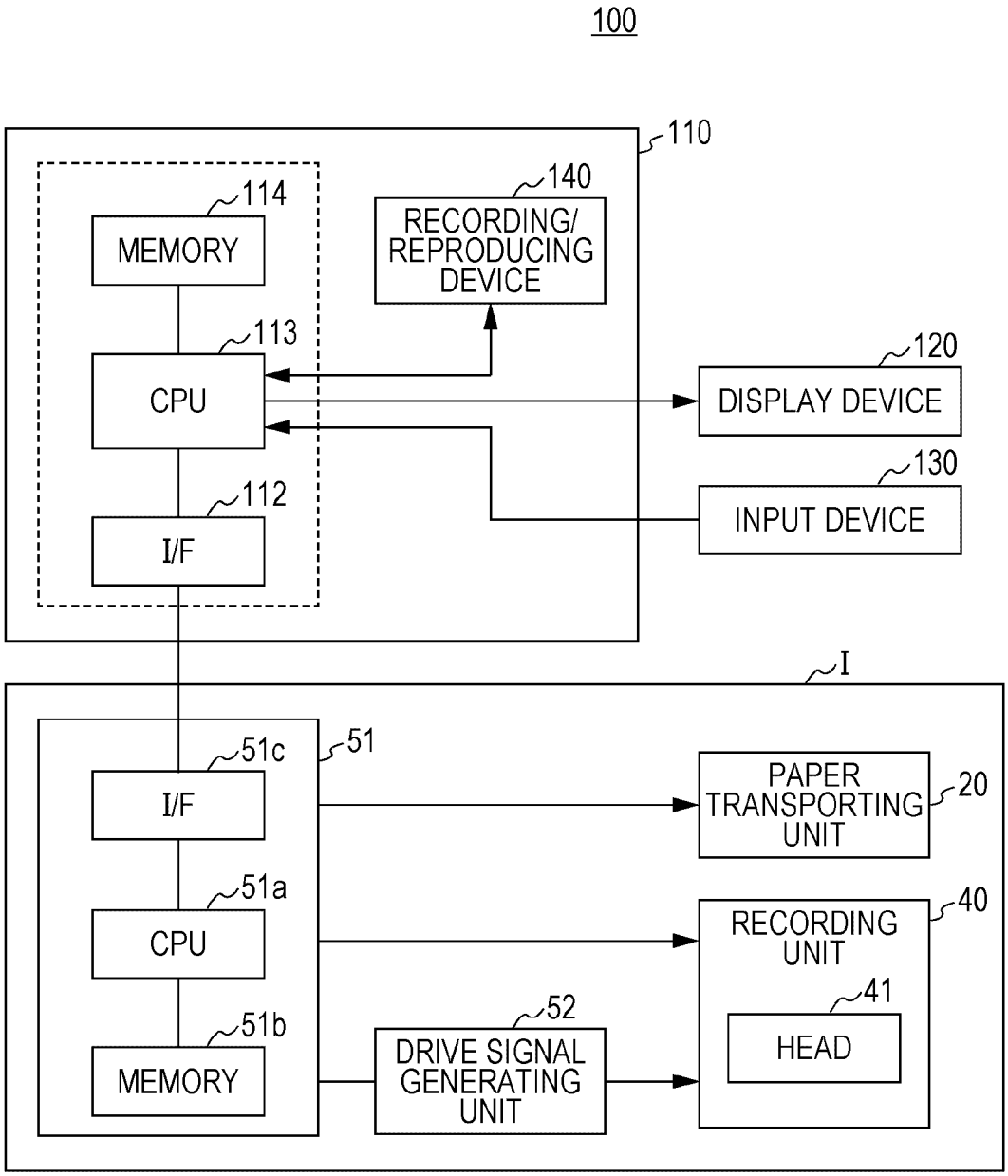
FIG. 1 is a block diagram of a printing system used in embodiments of the invention.

FIG. 1 is a block diagram of a printing system 100 in this first embodiment. Hereinafter, the outline configuration of the printing system 100 employed in this first embodiment will be described referring to FIG. 1.

The printing system 100 includes an ink jet recording apparatus I (hereinafter also referred to as "an ink jet printer I" or just "a printer I") (see FIG. 2), which serves as a printing apparatus, a computer 110, a display device 120, and an input device 130. The printer I prints images on a recording medium S, such as paper, cloth, or a film. The computer 110 is communicably connected to the printer I via an interface 112. Further, in order to allow the printer I to print images, the computer 110 outputs printing data corresponding to the images to the printer I. The computer 110 includes a CPU 113, a memory 114, the interface 112, and a recording/reproducing device 140. Further, computer programs, such as application programs and a printer driver, are installed in the computer 110. The recording/reproducing device 140 corresponds to, for example, a flexible disk drive device or a CD-ROM drive device.

The display device 120 corresponds to, for example, a liquid crystal monitor. The display device 120 serves as a device for displaying, for example, a user interface for a computer program. The input device 130 corresponds to, for example, a keyboard and a mouse device.

Figure 2:
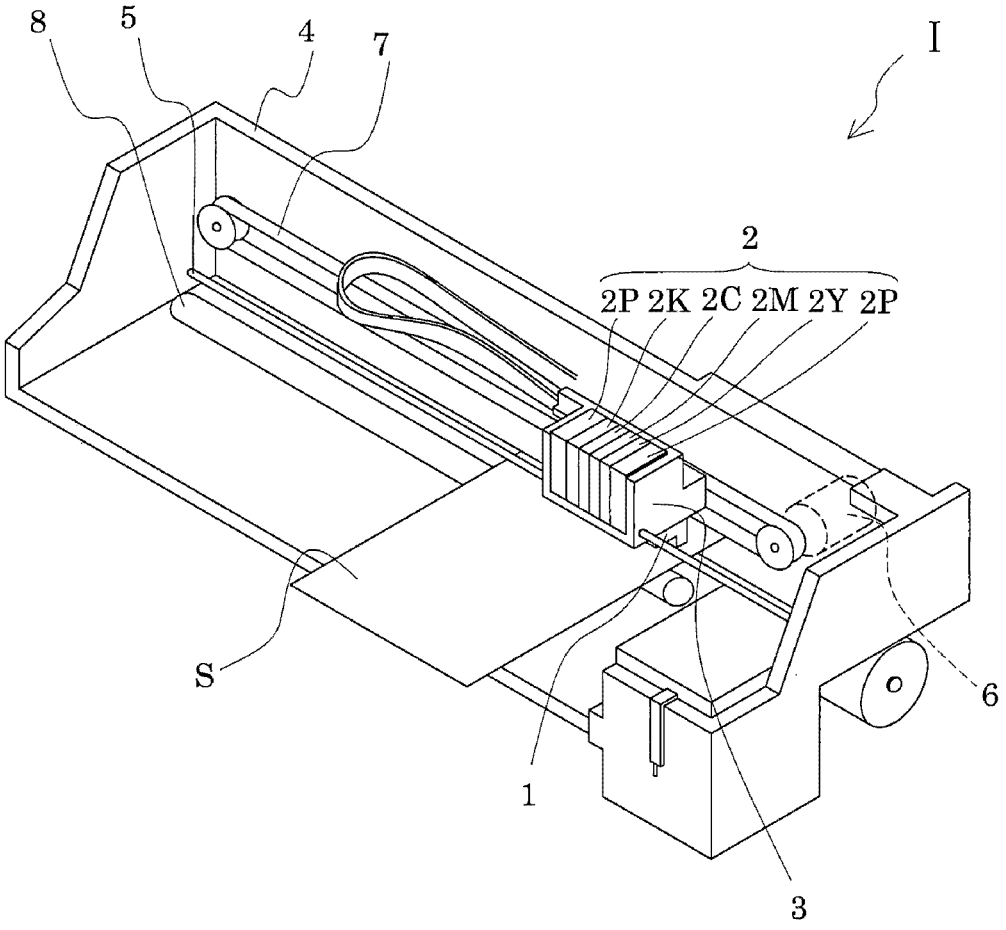
FIG. 2 is a perspective view of a printer used in embodiments of the invention.

FIG. 2 is a perspective view of the ink jet printer I. In the ink jet recording apparatus I shown in FIG. 2, a cartridge 2 is attachably/detachably attached to a recording head 1. Here, the cartridge 2 constitutes a liquid supplying means. A carriage 3 mounts the recording head 1, and is attached to a carriage shaft 5 so as to be freely movable in a shaft direction of the carriage shaft 5. The carriage shaft 5 is secured to an apparatus body 4.

Further, the driving force of a driving motor 6 is transmitted to the carriage 3 through a plurality of toothed wheels (not illustrated) and a timing belt 7, thereby allowing the carriage 3, mounting the recording head 1, to move along the carriage shaft 5. Further, in the apparatus body 4, a transport roller 8 is provided as a transporting means, and a recording medium S is transported by the transport roller 8. Here, the recording medium S is a recording medium such as paper. Note that the transporting means for transporting the recording medium S is not limited to the transport roller 8, but may be a belt, a drum, or the like.

Further, in the example described above, the ink jet recording apparatus I is configured to allow the cartridge 2, serving as the liquid supplying means, to be mounted in the carriage 3, but without being limited to this configuration particularly, for example, a configuration that allows liquid supplying means, such as ink tanks, to be fixed to the apparatus body 4, and allows the liquid supplying means and the recording head 1 to be coupled to each other via supply piping, such as a tube, may be employed. Further, the liquid supplying means may not be mounted in an ink jet recording apparatus.

The recording head 1 includes a plurality of nozzle rows, and is configured to be capable of ejecting an ink serving as a pretreatment liquid (i.e., a pretreatment ink (P)) and predetermined colored inks (for example, a yellow (Y) ink, a magenta (M) ink, a cyan (C) ink, and a black ink (K) ink) through the respective nozzle rows. In the present embodiment, two nozzle rows for use in the ejection of the pretreatment liquid are disposed at both scanning direction sides, and nozzle rows for use in the ejection of the yellow (Y) ink, the magenta (M) ink, the cyan (C) ink, and the black (K) ink are disposed between the two nozzle rows. Thus, the cartridge 2 includes two cartridges 2P associated with the pretreatment liquid at its both sides, and cartridges 2Y, 2M, 2C, and 2K associated with the respective yellow (Y) ink, magenta (M) ink, cyan (C) ink, and black (K) ink between the two cartridges 2P. Configuring in this manner achieves to eject the pretreatment liquid on the recording medium S, and further eject the colored inks on the pretreatment liquid.

Here, the pretreatment liquid is an ink that does not include color materials virtually, and that is used to improve fixation to a recording medium (a medium) and a maximum ejection quantity. Examples of the pretreatment liquid include, but are not limited to, a liquid including multivalent metal salt, such as resign or phosphate, a liquid including a surfactant, and a liquid including buffer solution. Further, the pretreatment liquid is vertically colorless and transparent, but slightly expresses a luster due to resign or a material that causes a luster change, and such a pretreatment liquid is a usage target pretreatment liquid.

Further, the ink jet printer I includes a control unit 51. This control unit 51 performs overall control of the operations of the individual constituent devices described above. The control unit 51 includes a CPU 51*a*, a memory 51*b*, and an interface 51*c*. The CPU 51*a* performs arithmetic operations and the like. The memory 51*b* stores therein programs, the results of the arithmetic operation, and the like. The interface 51*c* performs communication with external devices. The control unit 51 controls a paper transporting unit 20, a recording unit 40, and a drive signal generating unit 52.

The drive signal generating unit 52 supplies a drive signal COM to each of piezoelectric elements included in a head 41 of the recording unit 40. Digital data for defining the shapes of drive signals is transmitted from the control unit 51 to the drive signal generating unit 52, and the drive signal generating unit 52 generates the drive signal COM on the basis of the digital data.

Figure 3:
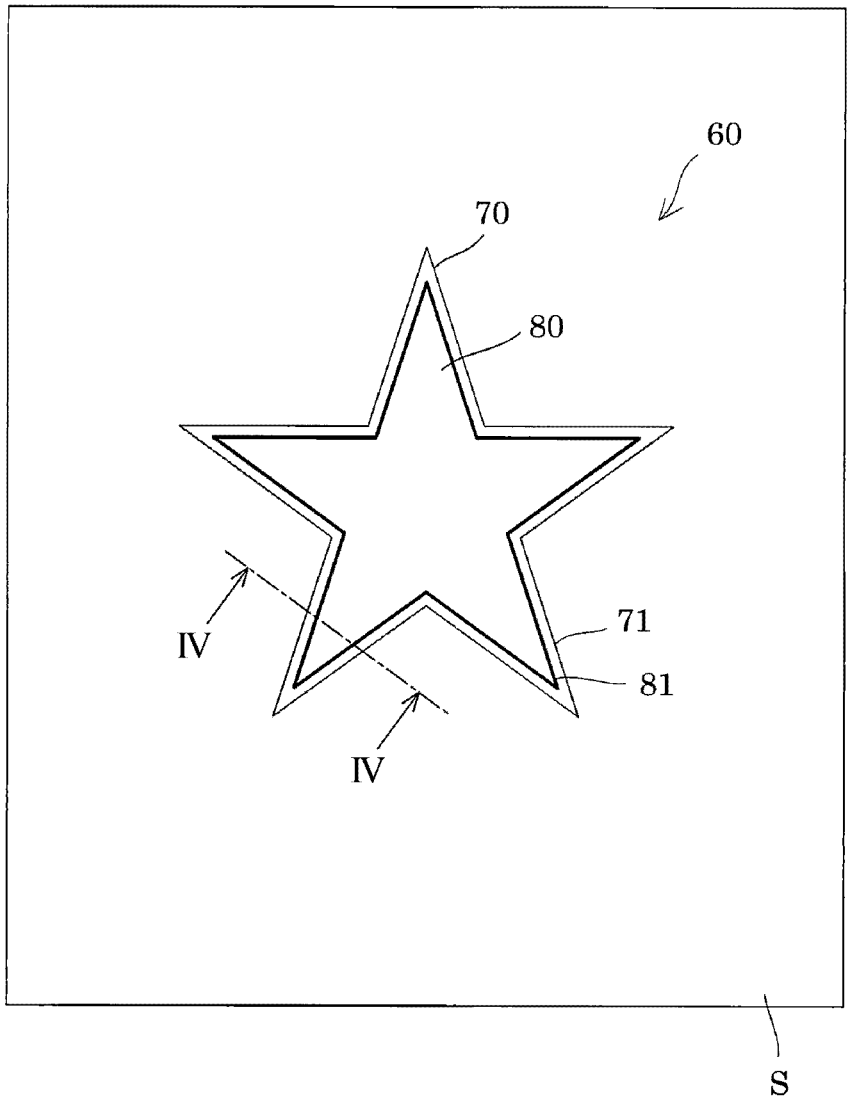
FIG. 3 is a plan view of a printing medium resulting from printing according to a first embodiment of the invention.

FIG. 3 is a plan view of a printing medium, that is, a printed material having been formed by means of a printing method according to this first embodiment.

Figure 4:
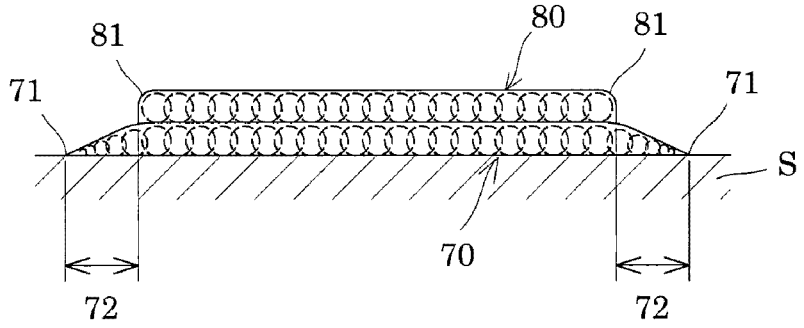
FIG. 4 is a cross-sectional view of the printing medium illustrated in FIG. 3 taken along the line IV-IV of FIG. 3.

FIG. 4 is a cross-sectional view of the printing medium illustrated in FIG. 3 taken along the line IV-IV of FIG. 3. Here, FIG. 4 schematically indicates a cross section of an image, and indicates a first image 70 and a second image 80 using ink dots having been ejected onto the recording medium S. Note that, although, not only, actually, the first image 70 and the second image 80 are not formed so as to protrude upward from the recording medium S, but at least part of the first image 70 and the second image 80 penetrates into the recording medium S, but also, actually, the first image 70 and the second image 80 form an image 60 in a state in which at least part of the first image 70 and the second image 80 is harmoniously integrated, the recording medium S, the first image 70, and the second image 80 are illustrated in a state in which they are stacked on one another in a thickness direction.

As shown in FIG. 4, the image 60 includes the first image 70, formed on the recording medium S, and the second image 80, formed on the first image 70, and the first image 70 is formed so as to be slightly larger than the second image 80. Further, an edge 71, that is, the edge of the first image 70, exists outside an edge 81, that is, the edge of the second image 80, and an extra portion 72 exists outside the second image 80.

Here, a pretreatment liquid forming the first image 70 is a virtually transparent ink, and the extra portion 72 is virtually transparent. Providing the extra portion 72 in such a manner is intended to allow the second image 80 to be formed fully on the first image 70 even when an out-of-alignment condition occurs when the second image 80 is formed after the formation of the first image 70.

Figure 5:
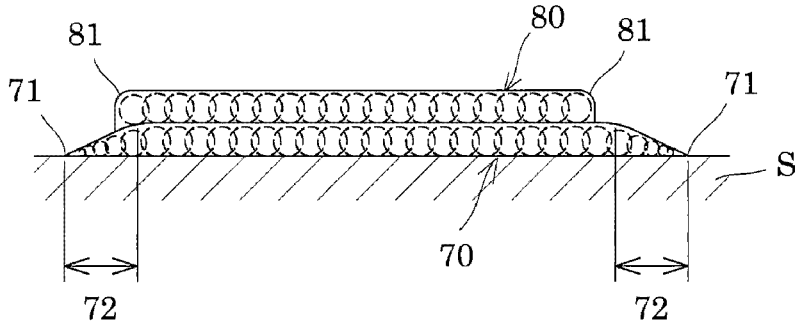
FIG. 5 is a cross-sectional view of a modified example of the printing medium illustrated in FIG. 4.

FIG. 5 illustrates a case where the second image is printed in a state of being out of alignment with the first image. As shown in FIG. 5, even when the second image 80 is formed in a state of being out of alignment with the first image 70, the edge 81 of the second image 80 does not exist outside the edge 71 of the first image 70, but exists on the extra portion 72 of the first image 70, and thus, this configuration achieves the prevention of the degradation of image quality. That is, when the second image 80 is formed so as to allow the edge 81 of the second image 80 to exist outside the first image 70, as a result, a portion where the second image 80 is formed directly on the recording medium S exists, and the existence of such a portion causes the difference between coloring and exuding degrees, thereby causing the degradation of image quality.

Note that, when the image 60 is printed, such an out-of-alignment condition between the images arises due to transport error between transport operations and error between ink ejection directions, and thus is difficult to completely prevent.

In the present embodiment, the extra portion 72 of the first image 70 is formed outside a particular edge 81, that is, the edge 81 of the second image 80 having been formed in a state of being not out of alignment with the first image 70, and further, the extra portion 72 is formed such that the ejection amount per area at a position on the extra portion 72 is decreased further as the position is located further toward the outside from a position corresponding to the edge 81 of the specific second image 80. That is, the extra portion 72 is configured such that the amount of the ejected pretreatment liquid at a position on the extra portion 72 is decreased further as the position is located further toward the outside. Even though the pretreatment liquid is virtually transparent, the extra portion 72 is a viewable portion, and thus, the above configuration, which reduces the amount of the pretreatment liquid ejected on the extra portion 72, brings about an advantageous effect of making the outline of the edge 71 of the extra portion 72 unclear, and thus, contributes to the improvement of image quality.

Further, in the present embodiment, in order to cause the ejection amount per area for the extra portion 72 at a position thereon to be decreased further as the position is located further toward the outside, the extra portion 72 is formed by a plurality of dots such that the dot diameter of a dot among the dots is reduced further as the position of the dot is located further toward the outside. It should be noted that, in order to cause the ejection amount per area at a position on the extra portion 72 to be decreased further as the position is located further toward the outside, without changing the dot diameter, dots having the same dot diameter may be ejected onto a region from the inside to the outside of the extra portion 72 such that the degree of overlapping between a pair of adjacent dots among the dots is reduced further as the position of the pair of adjacent dots is located further toward the outside, or both of the dot diameter and the degree of overlapping may be changed.

The printing of the image 60 including such the first image 70 and the second image 80 is performed by allowing the image 60 to be generated through image processing software on the computer 110 to which image data is input.

First, upon input of the image data, the computer 110 generates printing data corresponding to the second image 80, and further specifies the edge 81 of the second image 80. In conversion processing on the image data, the computer 110 performs resolution conversion processing and color conversion processing. Next, the computer 110 generates printing data corresponding to the first image 70 including the extra portion 72 having been added to a portion outside the outline of the second image 80. Further, the computer 110 performs the resolution processing such that, for the extra portion 72, the ejection amount per area at a position on the extra portion 72 is degreased further as the position is located further toward the outside from a portion corresponding to the edge 81 of the second image 80.

Next, the computer 110 performs halftone processing on the second image 80, that is, a color image resulting from the conversion processing, and the first image 70, that is, an image corresponding to the pretreatment liquid and resulting from the conversion processing. The halftone processing is processing for making a conversion from CMYK pixel data and pixel data corresponding to a pretreatment liquid P into grayscale data based on a small number of stages representable by the printer I. With this halftone processing, the CMYK pixel data representing, for example, 256 grayscale levels and the pixel data corresponding to the pretreatment liquid P are converted into dot data sets each consisting of pieces of data each representing a grayscale value corresponding to one of four stages (a large size dot, a middle size dot, a small size dot, and the absence of a dot). With this conversion, the two kinds of pixel data are converted, for each of the ink colors, into a dot data set consisting of pieces of data each representing a grayscale value corresponding to one of the four stages. Through the above processing, for each of a cyan ink C, a magenta ink M, a yellow ink Y, a black ink K, and the pretreatment liquid P, it is determined which size dot is to be formed on which one of dots.

Next, rasterization processing is performed. The rasterization processing is processing for changing each of the dot data sets having been obtained through the halftone processing into a corresponding data set consisting of pieces of data that are arranged in order in accordance with which a corresponding one of the colored inks and the pretreatment liquid P is to be ejected. Further, the printer I performs printing on the basis of data sets resulting from the rasterization processing.

In this manner, the first image 70, that is, an image formed on the lower layer and corresponding to the pretreatment liquid, and the second image 80, that is, a color image formed on the upper layer, are printed, and even when the position of the edge 81 of the second image 80 is out of alignment with the first image 70 due to the transport error or the like, the edge 81 of the second image 80 is located on the extra portion 72, and thus, the prevention of the degradation of printing quality is achieved. Moreover, the extra portion 72 of the first image 70 is formed such that the ejection amount per area at a position on the extra portion 72 is decreased further as the position is located further toward the outside. This configuration, therefore, brings about a delustering effect, and thus, makes it hard to visually recognize a luster that might be otherwise viewed on the extra portion 72. Accordingly, this configuration achieves the reduction the degradation of quality of formed images.

Second Embodiment

Figure 6:
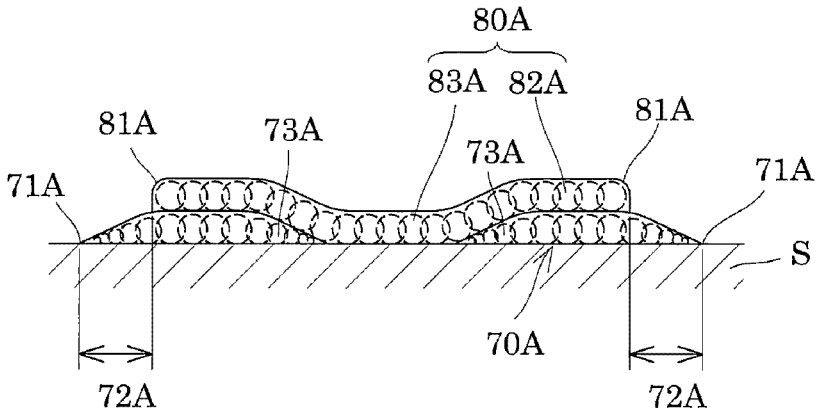
FIG. 6 is a cross-sectional view of a printing medium resulting from printing according to a second embodiment of the invention.
Figure 7:
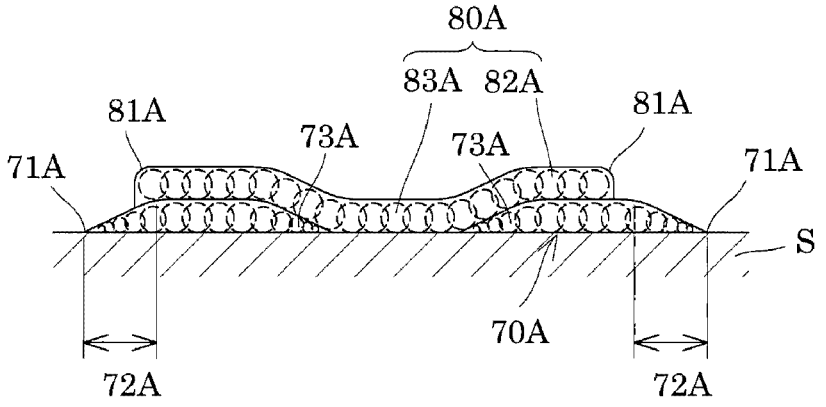
FIG. 7 is a cross-sectional view of a modified example of the printing medium illustrated in FIG. 6.

FIGS. 6 and 7 are cross-sectional views of printing media, that is, printed materials in this second embodiment, and correspond to the cross-sectional views taken along the line IV-IV of FIG. 3.

In the first embodiment described above, the first image 70 are provided under the entire second image 80, whereas, in this second embodiment, a first image 70A is provided at only a portion adjacent to and under the outline of a second image 80A. The first image 70 is configured so as to bring about the advantageous effect of preventing the degradation of image quality due to particularly exuding of the outline of the second image 80, and in this second embodiment, the same advantageous effect is also brought about.

The first image 70A is provided at only a portion under the outline of a second image 80A, and does not exist in a central portion between mutually facing portions of the outline of the second image 80A in the cross-sectional view in FIG. 6. Further, the first image 70A is configured to include an extra portion 72A by which an edge 71A of the first image 70A is located outward from an edge 81A of the second image 80A. Further, under a portion inside the edge 81A of the second image 80A, an inner portion of the first image 70A is formed, and in this inner portion of the first image 70A, an inclined portion 73A is provided. This inclined portion 73A is configured such that the ejection amount per area at a position on the inclined portion 73A is decreased further as the position is located further inward. This configuration causes color tone, coloring, and the like of an image not to be largely changed between a region 82A, that is, a region under which the inner portion of the first image 70A exists as a foundation layer of the second image 80A, and a region 83A, that is, a region under which the inner portion of first image 70A does not exist as the foundation layer. It should be noted, however, that the inclined portion 73A is not necessarily provided.

FIG. 7 indicates a case where the second image 80A is printed in a state of being out of alignment with the first image 70A. As shown in FIG. 7, even in the case when the second image 80A is printed in a state of being out of alignment with the first image 70A, the edge 81A of the second image 80A does not exist outside the edge 71A of the first image 70A, but just exists on the extra portion 72A of the first image 70A, and thus, the prevention of the degradation of image quality is achieved.

Others

In the aforementioned ink jet recording apparatus I, the configuration in which the recording head 1 is mounted in the carriage 3 and is allowed to move in a main-scanning direction is exemplified, but the invention is not limited to this configuration. The invention can be also applied to, for example, a so-called line-type printing apparatus configured to allow the recording head 1 to be fixed and allow the recording medium S to move in a sub-scanning direction.

Further, the invention is intended to be widely applied to overall types of liquid ejection heads. Example of a type of liquid ejection head to which the invention can be applied include, but are not limited to, a recording head including various types of ink jet recording heads used in image recording apparatuses such as printers; a color material ejection head for use in manufacturing color filters for liquid crystal displays; an electrode material ejection head for use in forming electrodes of an organic EL display, an FED (Field Emission Display), and the like; and a living organic material ejection head for use in manufacturing biochips. Further, the ink jet recording apparatus I, taken as an example of the liquid ejection apparatus and having been described above, can be also applied to a liquid ejection apparatus including any one of the above-described other types of liquid ejection heads.

The entire disclosure of Japanese Patent Application No. 2016-192146, filed Sep. 29, 2016, is expressly incorporated by reference herein.

What is claimed is:

1. A printing method comprising:

forming a first image by ejecting a pretreatment liquid in a first direction toward a print medium; and forming a second image on the first image by ejecting a colored ink onto the first image in the first direction, wherein the first image comprises an extra portion by which an edge of the first image exists on an outside of an edge of the second image, in a second direction transverse to the first direction, and wherein an amount of the ejection of the pretreatment liquid onto the extra portion per area at a position on the extra portion decreases further as the position is located further toward the outside from the edge of the second image, and wherein, the second image comprises a central portion disposed between two extra portions of the end portions in the second direction, the central portion being deposited on a portion of the printing medium without the first image.

2. The printing method according to claim 1, wherein the extra portion of the first image is formed by a plurality of dots that are arranged toward an outside from a position corresponding to the edge of the second image up to the edge of the first image.

3. The printing method according to claim 2, wherein a dot diameter of a dot among the plurality of dots in the extra portion is reduced further as the position of the dot is located further toward the outside of the first image.

4. The printing method according to claim 2, wherein a degree of overlapping between a pair of adjacent dots among the plurality of dots in the extra portion is reduced further as the position of the pair of adjacent dots is located further toward the outside of the first image.

5. The printing method according to claim 1, wherein the first image is formed under the second image so as to fully cover the second image.

6. A printing method comprising:

forming a first image by ejecting a pretreatment liquid in a first direction; and forming a second image on the first image by ejecting a colored ink onto the first image in the first direction, wherein the first image has extra portions by which both edges of the first image exist on both outsides of both edges of the second image in a second direction transverse to the first direction, and wherein an amount of the ejection of the pretreatment liquid onto the extra portions per area at a position on the extra portions decreases further as the position is located further toward the outside from the edge of the second image.

7. A printing method comprising:

forming a first image by ejecting a pretreatment liquid in a first direction; and forming a second image on the first image by ejecting a colored ink onto the first image in the first direction, wherein the first image has an extra area by which a perimeter of the second image is continuously environed in a planar view from the first direction, and wherein an amount of the ejection of the pretreatment liquid onto the extra area per unit area at a position is lower, as the position is near the edge of the extra area.

* * * * *